US006006159A

United States Patent [19]

Schmier et al.

[11] Patent Number: 6,006,159

[45] **Date of Patent: *Dec. 21, 1999**

[54] PUBLIC TRANSIT VEHICLE ARRIVAL INFORMATION SYSTEM

[76] Inventors: Kenneth J. Schmier, 880 Green St., San Francisco, Calif. 94133; Paul Freda, 7 Commodore Dr. #358, Emeryville, Calif. 94608

[ * ] Notice: This patent issued on a continued prosecution application filed under 37 CFR 1.53(d), and is subject to the twenty year patent term provisions of 35 U.S.C. 154(a)(2).

[21] Appl. No.: 08/696,811

[22] Filed: Aug. 13, 1996

Related U.S. Application Data

[60] Provisional application No. 60/002,303, Aug. 14, 1995.

[51] Int. Cl.[6] ..... G08G 1/123

[52] U.S. Cl. ..... 701/200; 701/204; 701/213; 340/988; 340/994

[58] Field of Search ..... 701/200, 204, 701/207, 208, 209, 211, 213, 117; 73/178 R; 340/988, 990, 994

[56] References Cited

U.S. PATENT DOCUMENTS

| | | | |
|---|---|---|---|
| 4,307,859 | 12/1981 | Hayashi et al. | 246/124 |
| 4,799,162 | 1/1989 | Shinkawa et al. | 340/994 |
| 4,812,845 | 3/1989 | Yamada et al. | 340/995 |
| 4,937,751 | 6/1990 | Nimura et al. | 364/449 |
| 5,400,020 | 3/1995 | Jones et al. | 340/994 |
| 5,461,374 | 10/1995 | Lewiner et al. | 340/994 |
| 5,483,234 | 1/1996 | Carreel et al. | 340/994 |
| 5,483,454 | 1/1996 | Lewiner et al. | 701/200 |
| 5,489,898 | 2/1996 | Shigekusa et al. | 340/988 |
| 5,493,295 | 2/1996 | Lewiner et al. | 340/994 |
| 5,504,491 | 4/1996 | Chapman | 342/357 |
| 5,541,845 | 7/1996 | Klein | 364/449 |
| 5,614,898 | 3/1997 | Kamiya et al. | 340/995 |
| 5,657,010 | 8/1997 | Jones | 340/994 |

FOREIGN PATENT DOCUMENTS

| | | |
|---|---|---|
| 2093457 | 10/1994 | Canada . |
| 0131211A1 | 1/1985 | European Pat. Off. . |
| 0219859A2 | 4/1987 | European Pat. Off. . |
| 0410137A2 | 1/1991 | European Pat. Off. . |
| 0511447A2 | 11/1992 | European Pat. Off. . |
| 2185824 | 1/1974 | France . |
| 2556864A | 6/1985 | France . |
| 2704965 | 11/1994 | France . |
| 9406990 | 8/1994 | Germany . |
| 06044495A | 2/1994 | Japan . |
| 2281141 | 2/1995 | United Kingdom . |

*Primary Examiner*—Gary Chin
*Attorney, Agent, or Firm*—Philip A. Dalton

[57] ABSTRACT

A system for notifying passengers waiting for public transit vehicles of the status of the vehicles, including the arrival times of vehicles at stops. The system includes global position determining devices located in the vehicles for determining the location of the vehicles along their routes. A central processor or computer is coupled to the global position determining devices for receiving the locations of vehicles therefrom. The processor is programmed to compute and update from the present location of the transit system vehicles and electronically stored information a transit data table which includes status information for all the vehicles in the system, including the location of scheduled stops, connections to other transit vehicles at the stops, and the arrival times of vehicles at their stops. The vehicle status and other information, including news and advertisements are then made available for public access in a manner geared to the locations of the vehicles, the time of day, day of week, date, location, season, holiday, weather etc. Portable access means such as pagers, notebook and palm computers and telephones and stationary access means such as personal computers and telephones and display modules in communication with the central processor, receive the computed arrival time and other information for selected routes, stops, etc. from the central processor, and communicate the information to the passenger(s).

28 Claims, 3 Drawing Sheets

PUBLIC TRANSIT VEHICLE ARRIVAL INFORMATION SYSTEM

This is a continuation-in-part application of provisional patent application U.S. Ser. No. 60/002,303, entitled PUBLIC TRANSIT VEHICLE ARRIVAL INFORMATION SYSTEM, filed Aug. 14, 1995, in the name of co-inventors Kenneth J. Schmier and Paul (nmi) Freda.

TECHNICAL FIELD OF THE INVENTION

The present invention relates generally to scheduling systems for public transit vehicles. It relates in particular to a passenger information system for providing near real time prediction of arrival times of public transit vehicles at selected boarding or disembarkation points.

DISCUSSION OF THE RELATED TECHNOLOGY AND NEEDED FEATURES

Often complained of problems associated with public transportation include time wasted waiting for public transit vehicles to arrive at a passenger's particular transit stop, and uncertainty as to service and/or arrival time at transit connections or destinations. To verify this, one need only observe bus riders standing in the street at travel stops looking as far down the road as possible, attempting to see the next bus, and doing so several times in the course of waiting for even one bus. A transit vehicle line operator usually publishes a schedule indicating arrival and departure times of vehicles for the line's routes. The transit vehicle line operator, however, is often unable to maintain the schedule, particularly at peak traffic times, for reasons such as traffic conditions, weather conditions, passenger load, and vehicle malfunction. Furthermore, no matter how well an operator is able to maintain a schedule, a passenger who uses public transit or a particular line infrequently, or a passenger from outside of the area in which the particular transit vehicle operates, is unlikely to have a schedule readily available.

A passenger waiting at a transit stop for a transit vehicle cannot know for certain when the next vehicle will arrive at the stop. If a passenger arrives at the stop only a minute or so before a scheduled arrival time, and the next vehicle does not arrive at that time, the passenger may be uncertain as to whether or not the vehicle may have arrived and departed before he or she reached the stop, or if the vehicle will ever arrive. Such uncertainty, can, of course, be reduced by arriving sufficiently early at the stop to avoid missing a vehicle. This, however, consumes time, which essentially extends the duration of what may already be a long journey, and which might be better spent by the passenger in other more enjoyable and/or more productive activities.

Public transit passengers could make use of wasted waiting time and associated passenger stress could be reduced if a public transit vehicle arrival information system were available. Such a predictor would eliminate much of the stress related to public transit use. With such a predictor, waiting time could be used for more useful purposes, such as an extended stay at the passenger's point of origin, shopping, work, or neighborhood exploration.

For passengers using commuter buses at peak hours another point of uncertainty may be the availability of unoccupied seats or even standing room on an arriving vehicle. Even if a waiting passenger is relatively certain that a vehicle will arrive on time, the passenger may not be certain that an empty seat will be available when the vehicle arrives, or after any other waiting passengers in a line in front of the passenger have boarded. In this regard, a predictor of passenger load (passenger load includes seat load and/or standing load) could be a valuable adjunct to a predictor of arrival.

It should be noted that it may be desirable to determine seat load and available seats or seat spaces separately from standing room load and available standing space because, for example, the type of space available may affect a potential passenger's decision whether to ride a particular transit vehicle, wait for another bus at the same stop, go to a different stop, etc.

By way of example, a bus line may operate two or more vehicle routes between a waiting passenger's boarding point and end destination. Travel time between the boarding and destination point along the shortest route may be forty-five minutes, and along the longest route may be sixty minutes. If a passenger waiting for the next arriving shortest-route vehicle at the boarding point were aware that only standing room would be available on the shortest-route vehicle, but that a seat would be available on a longest-route vehicle, (accurately) predicted to arrive at the passenger's stop or boarding point at a given time, for example, five minutes ahead or five minutes behind the shortest route vehicle, in most cases, the passenger would opt for a seat on the longest-route vehicle. The additional ten or twenty minutes travelling time could be easily justified by the ability to read, work, sleep or simply travel more comfortably.

In contrast to the above situation, where a passenger's ride is relatively short or where arrival time is more important than seat availability (for example, the passenger has little time to spare to reach work or an appointment and thus cannot wait for other buses or use a longer-route bus), the prospective passenger may elect to take the earliest scheduled arriving bus, if it has either seat or standing space.

For passengers already riding on a transit vehicle, useful information would include notice of cross streets, notice of upcoming transit stops, notice of connecting transit lines, notice of local stores and business services, the time available before the connecting transit line vehicle arrives at the transfer stop, as well as its passenger load. Such passengers may also be interested in knowing the time available between service on the same route before a following vehicle will arrive at the same vehicle stop, or the time available before a vehicle arrives going in the return direction. With such information the transit rider would know if it is time efficient to get off the transit vehicle to run an errand at a neighborhood business and catch a subsequent transit vehicle.

For transit system supervision to efficiently manage distribution of vehicles in the system, it is desirable to have available information such as the location of all vehicles operating in the system, the average speed of vehicles between various points in the system and predicted passenger loads between various points in the system.

For transit vehicle operators, receiving timely operating instructions or orders from transit system supervision would be very useful in preventing the bunching of vehicles and other inefficient use of transit vehicle capacity. Examples of such instructions include: wait; you are ahead of schedule xx minutes, reduce speed as conditions permit; speed up; you are behind schedule xx minutes, speed up as conditions and speed limit permit; skip stops; transfer passengers to other vehicles; turn back; special stops; alternate routes; etc.

In summary, while an accurate predictor of the time of arrival would be particularly useful for a user of public transit vehicles, the usefulness of such predictors would be enhanced by making the associated status information widely available to the public and transit operators in real time, and by making the information available via a wide variety of displays and other access devices. In addition, the enjoyment and usefulness would be enhanced by providing additional status information such as the availability of seats on arriving vehicles, status information related to the location of a particular transit vehicle or vehicles, and by providing non-status information such as public announcements, news briefs and advertisements.

SUMMARY OF THE INVENTION

In one aspect, the present invention is directed to a system for notifying a passenger waiting for a public transit vehicle of the arrival time of the vehicle at a public stop. The system is applicable to a wide variety of vehicles such as boats, airplanes, helicopters, automobiles, vans, buses, trolleys, trains, etc. operating along aboveground routes, or combination aboveground routes and underground routes including tunnels. The system also is applicable to vehicles which travel along tracks, as well as to those which travel along road surfaces. Typically, the vehicle travels a predetermined route and may be situated at any location along the route. The stop is one of a plurality of stops along the route.

The system comprises six major classes of devices. These classes are: Vehicle Information Units, the Central Processor, Addressable Display Units, Non-Addressable Display Units, Telephone Information Systems, and On-Line Computer Information Systems.

The vehicle information units are comprised of a global positioning system device, or "GPS" device, located in each vehicle. Also located in each vehicle is an appropriate Passenger Load Sensor System or "PLSS" for estimating vehicle passenger load.

The GPS in each vehicle is in communication with a plurality of global positioning systems satellites for determining the location of the vehicle along the vehicle's route.

The PLSS is any system that obtains reasonably accurate measurement of vehicle passenger load. In one preferred embodiment the PLSS measures vehicle weight from spring deflections so that the processor of the vehicle information unit or the central processor may compute vehicle occupancy therefrom.

Other sensors may also collect information related to other vehicle systems the transit system wishes to monitor such as fuel, engine temperature, tire pressure, fuel mileage, or brake condition through a variety of additional sensor devices. Collectively the GPS, PLSS and these additional sensor devices are "the sensors".

The sensors, including the GPS and PLSS in each vehicle, are connected to a processor located in each for accepting the information from GPS, PLSS and other sensors. This processor is in communication with a transceiver that may be individually addressable so that the information received from the sensors can be relayed by wireless radio signal in conjunction with telephone or other available communication systems to a central processor as polled by the central processor or according to a timed schedule.

The information relayed from the vehicle information units to the central processor includes the transit vehicle identification, its assigned route identification, the coordinates of its location, its current passenger load, and any other data collected from additional sensors.

The central processor includes both a transceiver and processor capable of polling the vehicle information units and receiving all information collected by the vehicle information units throughout the Transit System from the vehicle information units wireless transmissions in response to the polling from the central processor or according to a timed schedule.

The central processor has access to electronically stored information concerning the vehicle's route. The route information includes the route specifications or map, and the location of each of the plurality of stops along the route. The route information includes historical or experience information, obtained from calculations of transit time for similar vehicles previously operating between appropriate points on the same transit route, and passenger load patterns experienced by other vehicles on the same route. Such historical data will be organized according to time of day, date and day of the year (i.e. Weekday, Saturday, Sunday, holiday, holiday season, rainy season, dry season, etc.).

The route information also includes contemporaneous route information received from other vehicles operating on the same route at the same time as well as operating information such as schedules.

The central processor includes means for computing, from the location of the vehicle and the electronically stored information, status information, for example, in the form of transit data tables which include the predicted arrival time of each transit vehicle operating in the system, or that will be operating in the system, at each transit stop along each vehicle's route, and the predicted passenger load of the vehicle when it arrives at that particular stop.

In one aspect, a transit data table comprises a file of electronic records formatted to include in each record the following: vehicle identification, route number, stop number, and the estimated time of arrival at a particular identified stop number together with the predicted passenger load at the identified stop (assuming the transit data table includes one record for each transit stop). Alternatively, each record contains estimated times of arrival at all of the stops along a given vehicle's route together with the predicted passenger load at all of the vehicle's stops (assuming the transit data table includes one record for each vehicle operating on a transit route). In addition, the records may include other useful information, such as but not limited to, special passenger notification information and optimal bus operational information. The transit data table preferably would include records for each stop for each vehicle operating on each route in the transit system.

In another aspect, the present information system uses transit data table software of a standardized format, and standardized computers and other components, thereby permitting widespread use of the system anywhere in the world.

The central processor routinely updates the transit data tables as new information is received from the vehicle information units.

The central processor routinely broadcasts the updated transit data table or tables by wired or wireless transmission, or a combination thereof, throughout the area serviced by the transit system, together with specially addressed information intended only for particular displays known to be operating in the system. The system updates the entire transit data table for a huge transit system in near real time.

The central processor also has the capability to implement special programs and formatting instructions to construct from transit data table information, operator input, tables of information messages together with variable location, time, and climate parameters for display of those messages and tables of advertising messages and location, time and climate parameters for displaying those messages, formatted displays for individual displays known to the system to have unique locations or purposes.

In one aspect, the transit data table broadcast by the central processor is received by a non-addressable display device capable of automatically receiving the transit data table or a subset of information contained therein, storing the data received in its electronic memory, and automatically updating itself every time it receives a new transmission of the transit data table. The device can appear to be of a form similar to an alphanumeric pager, and may actually be incorporated within such a device.

The display device includes the means to interrogate the transit data table stored in its memory in order to display information useful to its user. This can be as simple as scrolling through the transit data table. However, persons skilled in information systems will design useful indexing, formatting and display techniques that make this information easy to use and understand.

Such a display device may display information including the time of day when, or the number of minutes until, the next vehicle operating on a user selected transit route will arrive at a user selected transit stop and the predicted passenger load of that vehicle when it arrives at the selected stop. The device may also contain computational means to find the most efficient route between any two transit stops.

Various forms of larger non-addressable display devices can be built to display information at transit stops, and in public places. Such displays will include the capability to be programmed to display all transit data table information relevant to users of that particular transit stop or public location, together with informational or advertising messages.

In another aspect the display device may be an addressable display device. Addressable display devices are likely to be placed at frequently used transit stops, public places, and businesses. Addressable display devices will also be placed within transit vehicles in two generally separate locations for different purposes.

Addressable display devices located at transit stops may, for example, receive transmitted data from the central processor that makes the display show not only information related to time remaining before transit vehicles serving that stop arrive, but also intersperse among such information other messages of informational or advertising character. For example, the display might indicate that the next bus will arrive in twenty minutes, then automatically select an advertising message suitable to be acted upon by a person observing such a message during that person's wait time. For example, the system could automatically advertise cold drinks at a close by convenience store on hot days when the next vehicle is 10 minutes or more away from the vehicle stop. The system could automatically switch to displaying transit system information, civic notices or institutional advertisements not anticipating immediate response when the next vehicle is two minutes or less away from the stop.

In another aspect, similar displays installed in public places, businesses and museums permit coupling and coordinating appropriate messages with the above-described information regarding arriving transit vehicles. For example, displays may be placed near exits of department stores so that shoppers will remain in the store the indicated fifteen minutes rather than at the curb waiting for an arriving vehicle, thus generating additional sales for the retailer, then shift messages to upcoming events as the vehicles arrival becomes more immanent.

In yet another aspect, addressable display devices are mounted on or in moving transit vehicles. Three different types of displays can be placed within or on the exterior of transit vehicles operating within the transit system.

Addressable display devices for passengers preferably are mounted within the vehicle located to be in easy view of passengers. Several individual displays or a display unit with several screens can be mounted within a vehicle. These displays, for example, inform passengers of upcoming cross streets, transit stops, notice of connecting transit lines, the time available before connecting transit line vehicle arrives at the stop, or how long it will hold for passengers, notice of upcoming local stores and business services, destinations, information regarding the following transit vehicle for those who would like to step off the bus in order to do business, and informational and advertising messages related or not related to the location of the transit vehicle.

For instance, the display might show "Next stop Fillmore Street, northbound connecting bus route number XX arrives in 9 minutes. . . . Why not buy roses for your loved one at Romance Flowers, XXXX Fillmore Street?"

A second form of display unit located within the transit vehicle would be a display unit intended to alert only the transit vehicle operator to operational instructions from transit system supervision. For example, a display could be located in or upon the dashboard of the vehicle and have a display that indicates if the driver should wait, hold for connecting vehicle, speed ahead, skip stops, transfer passengers to another vehicle, turn back, make a special stop, use an alternative route or other information that would otherwise act to optimize utilization of transit vehicle capacity of the system.

Such driver-directed information would be based, at least in part, upon information compiled in the transit data tables.

In another aspect, a third type of addressable display unit is located at various positions on the exterior of the vehicle. Such units could receive instructions to display messages such as the arrival of time of the next vehicle, displayed as this vehicle pulls away, how long the vehicle will pause at its current location (so as to prevent unnecessary heart attacks to persons racing to catch the vehicle), advertising related or not related to the location of the vehicle, time of day and climate, and other informational messages.

In another aspect, all three of the foregoing vehicle displays could access one display unit, which would direct the various messages to appropriate display screens.

All non portable display devices might be solar powered in order to be economical to install and maintain. Persons skilled in the art can devise systems to protect these displays from the elements and from vandalism.

All display devices can be designed by persons skilled in the art to provide information to persons with visual handicaps or hearing handicaps.

The central processor will also communicates the Transit Data Table and updates to an automatic telephone access system, so that any person may determine vehicle arrival information as described above by telephone inquiry of the system and selection of route and stop by input to a touch tone phone as directed by the telephone system. Also, the telephone access system can determine and recommend the best transit route to an inquirer.

Finally, the central processor will communicate the Transit Data Table and updates to computer information systems such as the Internet and the World Wide Web, so that the information may be used by others.

In one specific aspect, the present invention is embodied in a system and method using global positioning system devices mounted in individual vehicles which determine the precise coordinate/location of the individual vehicles. That information is transmitted to one or more central computers, preferably via a wireless communication link, and more generally via any of the available communications wireless links or "hard-wired" links, including fiber optics links, radio, satellite, microwave, cellular, telephone, etc., and combinations thereof. Then, using the coordinate information and experience (information previously determined and stored in the computer memory regarding vehicle routes, speeds during various times of the day, days of the week, holidays, inclement weather, etc.), the central computer(s) generates transit data tables containing current data regarding the routes, locations, velocity/speed, arrival time at future stops and other status and operational information for all vehicles in the system, then controls the broadcast availability of that information in a manner which provides public access to the information via any or all of a number of access devices and systems. The available access means include visual displays, audiovisual displays, telephony, computers, the Internet system, etc. In addition, combinations of such devices and systems may be used. For example, a telephone may be used to access the transit data table information. Alternatively, pagers or pager-like devices may be used to display route information. In yet another of the almost endless number of possibilities, computers, including personal, portable, notebook, palm computers and personal digital assistants, may be used to access route information which is broadcast by wireless transmission and/or supplied to the telephone network and/or to the Internet system, etc., by or under the control of the central computer(s).

In another aspect, in addition to transit data table information, public interest and commercial information, such as news briefs, announcements and advertisements, are available over the system. The public broadcast nature of the system and the many types of access means which can be used permit accessing the system and this information from essentially any location. For example, notebook or palm computers coupled with radio receivers can be carried anywhere by individuals and accessed essentially anywhere, and standard telephones can be used to access the information from any telephone installation, while cellular telephones provide access from substantially anywhere within the transit district. Stationary or semi-portable access means such as displays can be located at residential, commercial and government sites, including but not limited to homes, restaurants, department stores, offices, theaters, ball parks, libraries, schools, city hall and courthouses.

As alluded to elsewhere here, displays can be located in the vehicles for making available to the passengers and drivers the various types of publicly-available information, such as the transit data table information, advertising, news and public interest announcements. Furthermore, access means such as displays can be used to provide information that is intended primarily or solely for the driver or operator of the vehicle. Such driver-specific information displays can be used to display safety and status information and instructions such as information regarding the time and distance to the next stop(s), instructions to speed up to a certain speed or slow to a certain speed, instructions to bypass the next stop or stops, to wait at a given stop, etc. The driver information displays can be, for example, a separate display or a part of the display in the driver's compartment.

In another aspect, the system can include one or more signal buttons which are located at suitable locations, including in transit vehicles and at transit stops, and are used to signal the central processor of the need for services, for example, mechanical breakdown, medical and/or police emergency, etc, and to request a response coupled with providing the exact location of the requester. Different circuits controlled by associated buttons or switches can be used to signal a need for different types of services and/or different levels of criticality or emergency. Preferably, to prevent inadvertent or intentional false signalling by passengers or others, the signal buttons are located in an area close to and under the physical control of the transit vehicle driver or other operator, for example, in the instrument panels of the transit vehicles.

In another aspect, the present invention additionally includes an arrangement, located on the vehicle, for determining the number of unoccupied seats in the vehicle. In one example, such an arrangement is provided by a plurality of bi-modal deflection sensors or pressure sensitive switches, one thereof mounted on each seat in the vehicle. The sensors are initially in a first mode, for example an "off" mode, when a seat is unoccupied and are switched to a second ("on") mode when the deflection sensor is activated by a passenger's weight alighting on the seat. A microprocessor polls the sensors at frequent intervals and stores a digital representation of the number of sensors in the off mode. This representation may be communicated to the central processor together with the location of the vehicle. The processor communicates the number of unoccupied seats to the display, together with the computed arrival time, whenever the status of the vehicle is updated on the display. In another example, not exclusive, the number of unoccupied seats can be estimated from the weight of the vehicle, which itself can be derived from the relative height of the vehicle measured by means such as deflection sensors which measure the height of the vehicle relative to a fixed-height position on the suspension or elsewhere.

BRIEF DESCRIPTION OF THE DRAWING

The accompanying drawing, which is incorporated in and constitutes a part of the specification, schematically illustrates a preferred embodiment of the invention and, together with the general description given above and the detailed description of the preferred embodiment given below, serves to explain the principles of the invention.

DETAILED DESCRIPTION OF THE PREFERRED EMBODIMENT(S)

Figure 1:
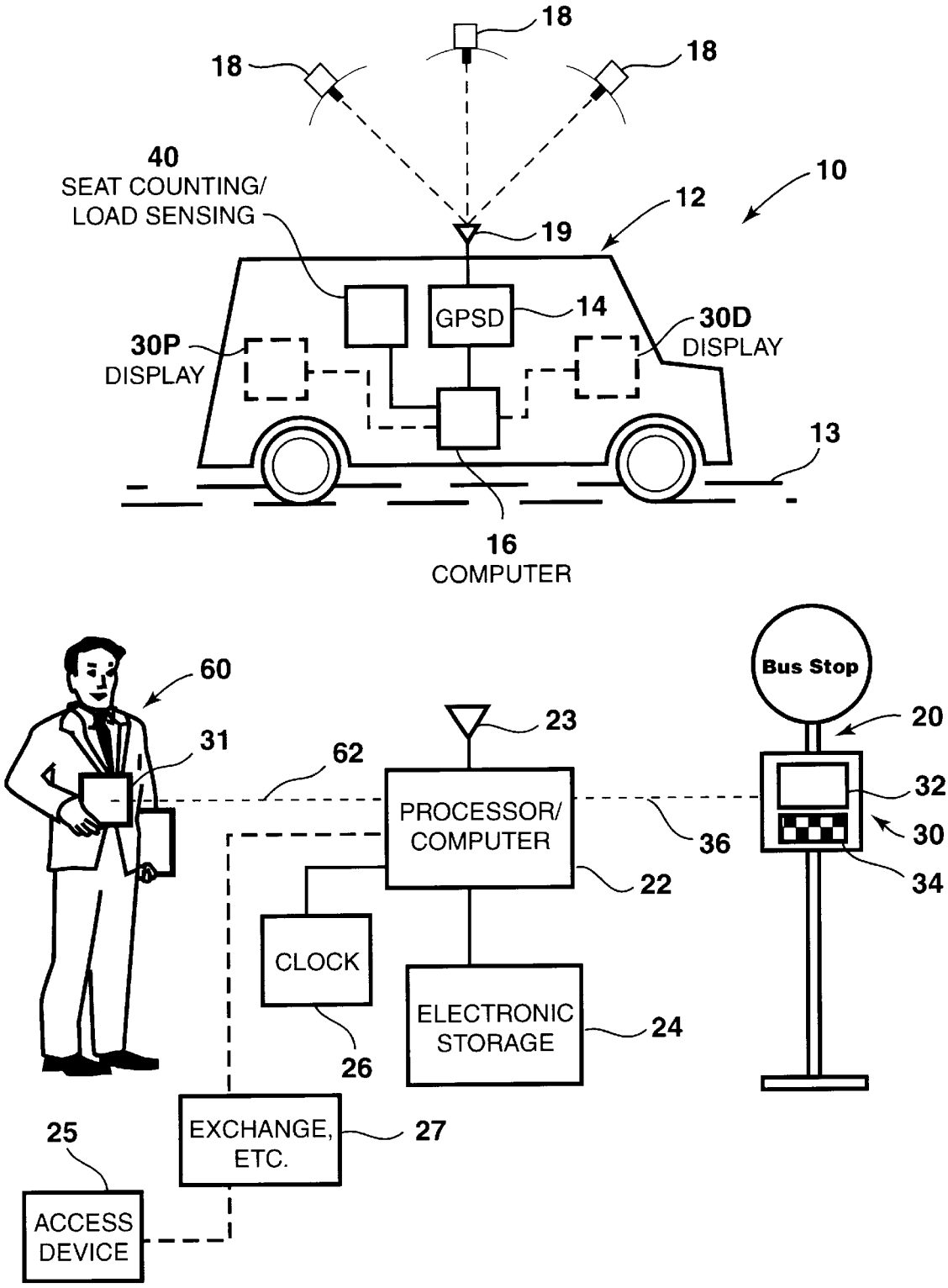
FIG. 1 is a block diagram schematically illustrating one preferred embodiment of a public transit vehicle arrival information system in accordance with the present invention, including a global positioning system for determining the location of a vehicle and an arrangement for determining unoccupied seat availability.

Turning now to the drawings, where like components are designated by like reference numerals, FIG. 1 schematically illustrates one preferred embodiment 10 of a transit vehicle arrival notification system in accordance with the present invention. Here, a vehicle 12 has located therein a global positioning system device 14 which includes or is connected to a microprocessor 16. Global positioning system 14 device is in communication with a plurality of orbiting satellites 18, such as those associated with the satellite navigational system maintained by the U.S. government, via vehicle antenna 19, and can determine the location of the bus at any time from the satellite feed.

The vehicle 12 can be any of a number of different types of vehicles, including buses, vans, etc., which operate on road surfaces such as surface streets and highways; buses, trolleys, trains, etc. which ride along rails, such as the rails 13 shown in phantom in FIG. 1; watercraft such as passenger boats or ferries; and aircraft such as airplanes and helicopters. For convenience and to emphasize the breadth of the invention, we refer to vehicle 12 as both a vehicle and a bus.

Please note, typically vehicle 12 is one of several such vehicles deployed by a transit vehicle operating company to operate over one or more routes in a given area. Each of the routes travelled by a particular vehicle typically is identified by a route number or letter. Vehicle 12 is scheduled to stop at one or more public transit stops 20 located on its route between a starting point and a destination point.

Microprocessor 16 is in wireless communication with a central processor system 22, for example, via a communications link such as wireless radio link established between antenna 19 of vehicle 12 and antenna 23 associated with central processor system 22. Central processor 22 may be operated by the transit vehicle operating company, and be in communication via one or more antennae such as 23 with some or all of the buses operated by that company. Alternatively, central processor 22 may be operated by a municipality or a service bureau and be in communication with buses operated by two or more transit companies.

Central processor 22 is in communication with electronic storage means 24. In electronic storage means 24 are stored the identification of all vehicles or buses in communication with central processor 22 and the location coordinates representing the routes of all vehicles in communication with central processor 22. Also stored are location coordinates of transit stops 20 along each of the routes and "normal" transit times for a bus between each of the stops. Preferably, the transit data table contains schedules or tables which list (1) each run of a transit vehicle for a given time period, such as a day, and associated schedule information including (2) the predicted time intervals between adjacent transit stops, (3) the associated predicted time of arrival at each stop for each run, and (4) the predicted change in historical passenger load at each stop. The predicted time intervals, arrival times and passenger loads are calculated based upon the history of these items, taking into account the month, week, day, time-of-day, etc., as well as other historical factors or patterns including weather, holidays, vacation seasons, school year holidays, etc. Also, information regarding current conditions or status can be input to the central processor means, either locally (at the central processor means itself) or remotely (for example, from transit vehicles, transit line booths, etc.), and used for revising the predicted time intervals, times of arrival and passenger loads for upcoming stops in the transit data table. Current information includes severe weather, transit line or local surface road construction, and other construction activity, etc. After updating the transit data table to reflect current information, the central processor means controls the broadcast of the revised schedule information throughout the area encompassing the transit system. The process of updating and broadcasting is done as quickly as technology allows, perhaps in a minute or less using present technology. In this way, continually updated near real time system information is available for all who provide, use, or relate to, the transit system.

In one aspect of the present invention, each vehicle automatically reports to the central processor 22 or, preferably, central processor 22 is programmed to communicate with (poll) each vehicle 12 which is currently "in-transit" to determine a location of the bus. This communication may be at some convenient short time-interval such as thirty seconds or one minute. Such a time-interval should be, for practical reasons, shorter than the shortest anticipated transit time between any two sequential stops. Locations of the in-transit buses determined from the communication are stored in electronic storage means 24 and updated after each communication. A master clock 26, connected to or incorporated in central computer 22, assigns a time-of-day to the system. The distance between any two sequential stops may be computed by central processor or computer 22 from the location of the stops and the route details. Alternatively, distances between sequential stops may be stored in a table or tables in storage means 24 and simply "looked-up" by processor 22. The tables store normal times as defined above for every operating vehicle in the system. Also, the tables hold schedules for buses entering the system.

From the distance and location information, the central computer calculates predicted arrival times at every vehicle stop on the route designated for a vehicle (and preferably uses the capabilities described subsequently to calculate a predicted passenger load). The computer predicts arrival times and passenger loads with increasing accuracy based upon the expanding data base covering vehicles travelling on the particular route under similar operating conditions at similar times of the day, week and month, and schedules. Such predictions can be checked against mathematical formulae to assure reasonableness, and to identify vehicle operational problems.

Each calculation can be updated regularly as new information is received from transit vehicles, and quickly. The update process for an entire transit system may only take seconds. Thus the system could be updated with actual system performance information in real time. The most recent calculations can be held in tables such as a "Current transit data table of Predicted Arrival Times and Passenger Loads" or "Transit Data Table", together with important operation information, for immediate use in supplying information to display units at transit stops and other locations.

At transit stop 20 are means for accessing the transit data table and other system information, illustratively in the form of one or more display modules 30. Display module 30 includes a display device 32, such as a liquid crystal display, a CRT (cathode ray tube) display and/or an LED (light emitting diode) display, for displaying information. Interactive display modules can be used which include, for example, a data input device 34, such as a set of switches, buttons, or a keypad. The display module(s) could also be mounted in locations such as office lobbies, stores, restaurants, museums, and other places where people gather. Display module 30 is in communication with central processor 22, for example, via a link 36 such as a wireless telephone link or a hardwired link.

The display modules 30 may be little more than alphanumeric digital pagers of the type regularly available to consumers, or pagers modified with larger screens 32. These units can be powered from electrical service at the stop, or to save installation costs, and where practical, solar power with battery back-up can be used. These devices may receive the entire transit data table information or a subset thereof. Alternatively, the display modules can be small computers capable of receiving the entire transit data table or a subset thereof and other messages, and capable of being programmed locally, or from the central computer, to format and display those the relevant transit data table and informational messages.

In another alternative arrangement, the display modules or units 30 receive the entire transit data table or a subset of the transit data table as well as programming instructions from the central computer so that the content of any particular display can be controlled from the central office.

The displays also can display varying levels of graphics and text, allowing the display of messages of public interest and advertising interspersed with transit data table. Each display can be separately addressable, so only messages important to one area may be directed only to that area.

The displays such as 30 can transmit the accessed information in audio or visual or audiovisual format. In addition, and referring to FIG. 1, the access means can be a telephone 25 which communicates with the central processor or computer 22 via a telephone exchange 27 or cellular installation, for transmitting in audio or audiovisual format the information which is broadcast electronically over the system under control of the computer. A server or other suitable device is used to store transit data table information and provide access from telephone(s).

Persons of ordinary skill can devise methods of protecting these devices from vandalism. Such devices may also include systems for audible reporting to the visually impaired.

Figure 6:
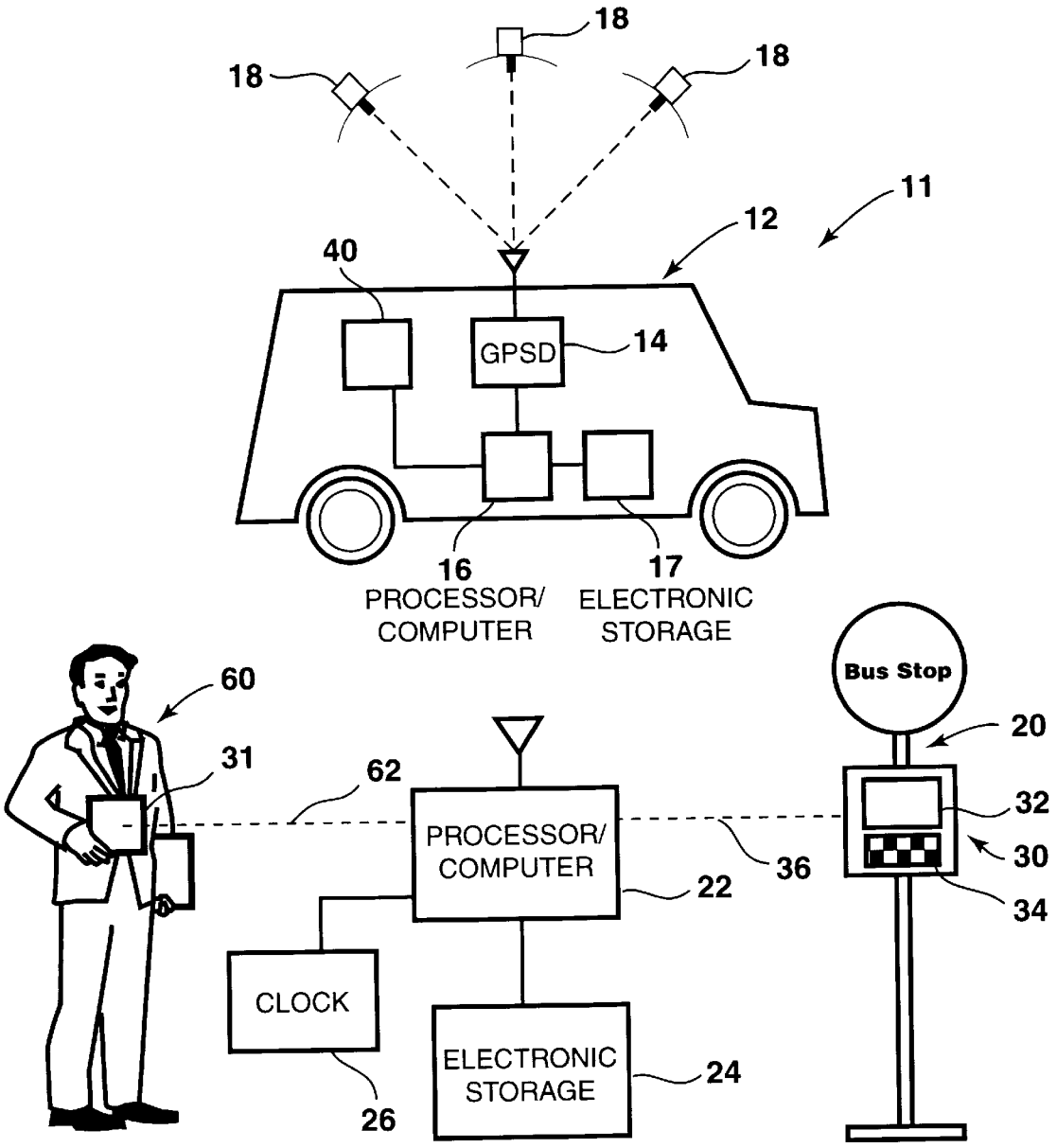
FIG. 6 is a block diagram schematically illustrating another preferred embodiment of a public transit vehicle arrival information system in accordance with the present invention.

Referring to FIGS. 1 and 6, access means, here one or more display modules designated 30P to indicate their location in vehicles for serving passengers, can be mounted at convenient and visible locations in transit vehicles. Such displays 30P can then display upcoming vehicle stops, important points of interest, connecting transit lines, destinations, destination arrival times, the arrival times of connecting vehicles, route change information, public interest and advertising messages, etc. Alternatively, one or more access means such as displays 30D can be used to provide information that is intended primarily or solely for the driver or operator of the vehicle. In addition to the information available at the passenger displays, such driver-specific information access means can be used to display safety and status information and instructions such as information regarding the time and distance to the next stop(s), instructions to speed up to a certain speed or slow to a certain speed, instructions to bypass the next stop or stops, etc. The driver information displays can be, for example, a separate display or a part of the display in the driver's compartment.

In one specific operating mode of system 10, a passenger waiting at stop 20 or at another location which displays information about lines which serve stop 20, enters a desired route number (or an alphanumeric code representing that route number) into a display module such as 30. The display module processes the entered route number, and a code identifying stop 20, and determines from the transit data table data received from central processor 22, information such as the predicted arrival time at stop 20, which is then retrieved and shown on a display module such as 30.

It will be evident to one familiar with the art to which the present invention pertains that central processor 22 may be programmed to provide not only information regarding the next bus of a particular route number to arrive at stop 20, but may also be programmed to provide more comprehensive information such as arrival times of the next two or more buses of a particular route number or the arrival times of the next one or more buses of all route numbers which are scheduled to stop at stop 20. Clearly, the more comprehensive the information, the more complex must be the display modules such as 30, 30D, 30P and 31.

Information from the system should be of great use to the transit operator in managing the system as well. The computer can determine the most efficient allocation of vehicles to meet passenger loads, and can schedule turn backs and other adjustments of operating schedules in order to eliminate "bunching"of transit vehicles. The sight of a bus speeding by a passenger in order to re-space vehicles will be far less annoying to the passenger if the display unit informs the passenger of what is happening, and also informs the passenger that a bus is following directly behind.

As noted above, in addition to knowledge of a bus's arrival time being useful for a waiting passenger, knowledge of availability of seating on an arriving bus may be equally important. Because of this, it is preferable that bus 12 include an arrangement for determining the passenger load of the bus. This information may be communicated to central processor 22, together with the location of bus 12, and stored in storage means 24. A history of changes in passenger load can then be calculated and stored in storage means 24 using actual passenger load information and historical changes in passenger load between stops for similar times of day, seasons, etc. Based upon this information, predictions for passenger load at upcoming stops can be calculated. Thus the arrival time of, and the available seats and/or standing room on bus 12 can be communicated to the display module for display thereon. It is preferable that the passenger-occupation-load-determining arrangement 40 function automatically, i.e., it is preferably not dependent on a driver of the bus for updating as passengers alight and board at each stop.

In a relatively simple form, such an automatic seat availability determining arrangement may be a device for estimating the instant weight of bus 12, for example a deflection sensor or strain gauge mounted on a wheel suspension component of the bus. Microprocessor 16 may be programmed to estimate passenger load from a signal from the deflection sensor representative of the weight of bus 12; the empty weight of the bus; and a predetermined "average" passenger weight. Such a simple device however can at best provide only an estimate of the number of unoccupied seats. Accuracy of the estimate will be influenced, in addition to differences between actual and average passenger weights, by factors such as vibration and fluctuating fuel load in bus 12.

Figure 2:
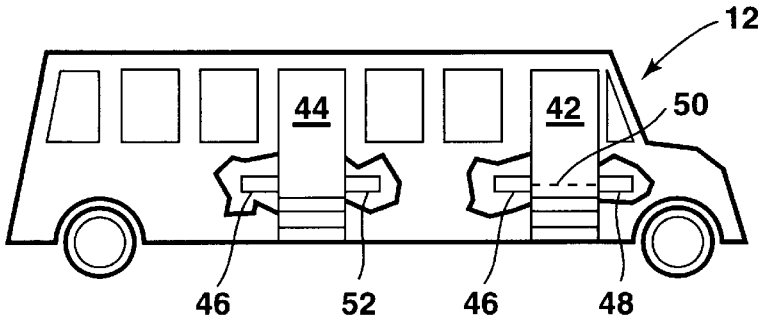
FIG. 2 is a partially cut-away view schematically illustrating a bus including weight or passenger counter sensors located at exit and entrance doors of a bus.
Figure 3:
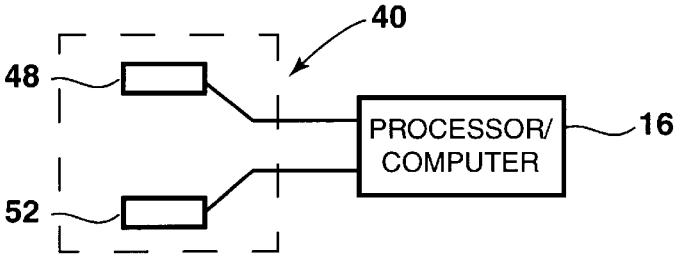
FIG. 3 is a block diagram schematically illustrating one example of the seat availability arrangement of FIG. 1, including the sensors or counters of FIG. 2.

Referring now to FIGS. 2 and 3, there is shown another arrangement for determining seat availability is illustrated. Here, bus 12 has a forward door 42 through which passengers board the bus, and a mid-point door 44 through which passengers alight from the bus (see FIG. 2). Located proximate opposite posts of door 42 is an optical transmitter 46, such as a light-emitting diode (LED), and a detector or receiver 48 for receiving a light beam (indicated by broken line 50) from transmitter 46. Receiver 48 is connected to microprocessor 16 as illustrated in FIG. 3. When beam 50 is broken by a passenger boarding through door 42, receiver 48 transmits a pulse to microprocessor 16 indicating that the passenger has boarded. Similarly, a light source 46 and a receiver 52 (also connected to microprocessor 16) are located at door 44 for counting passengers alighting from the bus. The difference between the number of passengers boarding and alighting and the total number of seats in the bus are used by microprocessor 16 to compute the number of unoccupied seats. That number is communicated to central processor 22 on demand. Please note, accurate passenger load monitoring using this arrangement is dependent upon the passengers entering and exiting via designated doors. Such ideal behavior may not prevail, particularly when accurate calculation is most needed, for example during rush hour.

Figure 4:
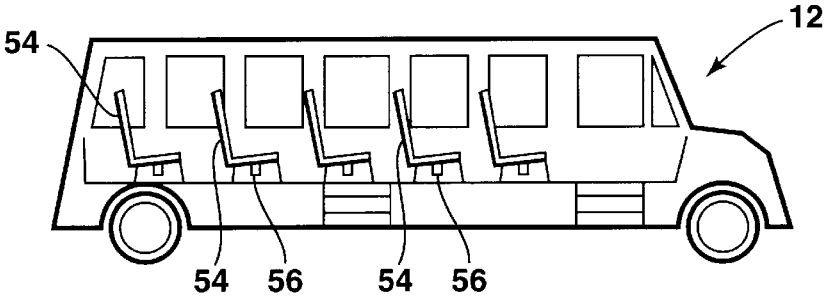
FIG. 4 is a cut-away view schematically illustrating a bus in which a seat occupancy detector is located under each passenger seat of the bus.
Figure 5:
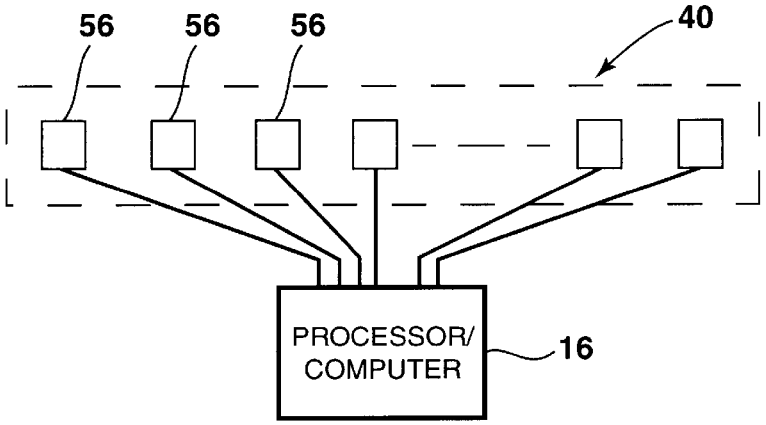
FIG. 5 is a block diagram schematically illustrating another example of the seat availability arrangement of FIG. 1, including the seat occupancy detectors of FIG. 4.

In another seat counting arrangement 40, depicted in FIGS. 4 and 5, each seat 54 in bus 12 has attached thereto a pressure sensitive switch or bi-modal deflection sensor 56 (see FIG. 4). Switch 56 is set to activate (turn "on") when a passenger sits on the seat, and deactivate (turn "off") when the passenger leaves the seat. The plurality of switches 56 is connected to microprocessor 16 (see FIG. 5). A polling communication from central processor 22 polls global positioning system 14 via microprocessor 16 to determine the location of bus 12, and also polls switches 56 via microprocessor 16 to determine how many switches are off, i.e., how many seats 54 are unoccupied.

Continuing now with reference to FIG. 6, in another embodiment 11 of a transit vehicle arrival notification system in accordance with the present invention, bus 12 (being one of a plurality of such buses) is provided with electronic storage means 17 in which data including the route of the bus and stop locations along that route are stored. (For simplicity, elements and systems such as displays 30P and 30D and telephone means 25 and 27 are not shown in FIG. 6, but it is understood such elements and systems are applicable to system 11, as well as to system 10, FIG. 1). Microprocessor 16 is programmed to compute from location data obtained from global positioning system device 14, and from the data stored in storage means 17 the anticipated arrival time of the bus at stops to be encountered along its route. This may be done, as discussed above, at regular, relatively short time-intervals.

When bus 12 of system 11 is polled by central processor 22, the computed arrival times and instant seat availability are transmitted to the central processor and stored in electronic storage means 24 attached thereto. In system 11 there is no requirement for storage 24 to store any route or stop location details. When central processor 22 is queried by display module such as 30, central processor 22 looks up the requested arrival times and capacity in storage 24 and transmits them to the module for display.

A particular advantage of either system 10 or system 11 is that a display module such as 30 for presenting arrival and seat availability information can receive wireless communications from central processor or computer 22. As the display modules such as 30 need receive only a short text message from processor 22 for display, the module can be made quite small and would require very little power to operate. Display module 30 at stop 20 for example could be easily powered by a small solar power generating unit of a type now used in many states on roadside emergency telephones.

A passenger 60 may also carry a portable display module 31 (shown exaggerated in size in FIGS. 1 and 6). Display module 31 could receive via a dedicated wireless telephone link (indicated by broken line 62) information from or selected by central processor 22. Module 31, in practice, need be no bigger or heavier, or cost no more than a small paging unit of a type which is now commonly used by many persons to receive text messages from a central office. The portable display modules 31, can be used to receive the transit data table, and access arrival information for any particular transit line and transit stop. In this way a person can know, without leaving home, work, a restaurant, etc., precisely when the next vehicle will arrive. The device will have the ability to also display all of the transit data table by scrolling through all data items or, on more sophisticated display devices, by direct access. The system will include programs for personal computers, palm top computers, electronic organizers and/or dedicated devices capable of determining the fastest means to reach any particular destination by analyzing various transit alternatives based upon user input parameters such as the number of blocks a passenger is willing to walk from the area of origination to the area of destination. Such analyses will be based upon real time transit operation information. Devices will include a priority display to make access of information for designated stops easy.

A portable display module 31 would be extremely useful for a business person or any person who commutes by bus. By way of example, the person may inquire into the arrival time and seat availability of buses before leaving the workplace. If it were found that a bus would arrive late or not have an available seat at the business person's usual transit stop, the business person need not venture to the transit stop, and could spend time, which would otherwise be spent waiting in line, gainfully, at work or shopping.

In summary, a public transit vehicle arrival notification system has been described. The system is for notifying a passenger waiting for a public transportation vehicle of the arrival time of the vehicle at a transportation stop. The vehicle may be one of a plurality of buses travelling one of a plurality of predetermined routes. The stop may be any one of a plurality of stops along a particular one of the routes. Details of the arrival time of the bus at the stop and details of seat availability on the bus are transmitted to a central computer.

A significant advantage of the system is that a waiting passenger may use a portable module to establish wireless communication with the central computer from any location within the operating range of the system. The central computer transmits the arrival time and seat availability to the module for display. The passenger has available at transit stops and other locations display module 30 and 30P and may carry on his or her person a portable display module 31, any or all of which provide news and weather information, announcements, advertising, etc., as well as a continuously updated electronic timetable which provides, in addition to bus arrival times, information regarding seating availability on arriving buses.

The advertising capability of the system provides needed revenue. Revenues to fund the system can come from the various transit agencies and government entities. However, revenues to support the system and to service the investment necessary to create the system can be obtained by selling advertising time associated with the display panels.

Such advertising can be of general area wide interest, or more interestingly, can be quite site specific. For instance, it would be possible to advertise to a bus stop in front of an ice cream shop, "The next bus is ten minutes away, how about a scoop of pralines and cream?" and another message to another bus stop. Such advertising might be a real boon to neighborhood business. Such advertising may also be timed to only appear at certain stops, times of day, days of week, special holidays, or a variety of other particular considerations of time, weather, location, and transit system movement.

Moreover, advertising messages may be timed with relation to the approach of the transit vehicle. For example, a message advertising the ice cream shop might be sent ten minutes before the bus arrival, because the customer would have time to react, while national advertisements would show in the minute before the bus arrived to assure the greatest audience. The advertising could also be related to weather or other timely considerations, for example advertising umbrellas in the store behind the bus stop during a rain storm.

Similarly, advertising messages can appear in transit vehicles that are relevant to the location of the transit vehicle and the time of day. Consider the power of the message "Roses $4.95 a dozen, next stop, next bus ten minutes behind" for the flower retailer and for romance in general!

The system could also send out messages of general interest over wide geographic areas, including Silent Radio.

Advertising opportunities on the cases of public display units can also be licensed for revenue. Since all transit riders are likely to regularly observe such displays, and since advertising can be made so site specific, advertising as a part of this system should be of significant value and affordable to a variety of national, local and neighborhood businesses.

The present invention has been described and depicted in terms of a preferred and other embodiments. The invention, however, is not limited by the embodiments described and depicted. Rather, the invention is limited only by the claims attached hereto.

What is claimed is:

1. A system for determining the location of vehicles operating over predetermined routes in a transit system, comprising: (1) a global positioning system device located in selected transit vehicles in the system for monitoring the position of said vehicles; (2) central processor means (a) storing an historical transit data table containing vehicle schedules of the travel times necessary for said vehicles to move from one stop to another along their routes under different conditions, advertisements and information for the operators of the vehicles, and (b) selecting from the transit data table a schedule of travel times applicable for current conditions along a given route and using the schedule of times from said transit data table and the position of said vehicles at a given time to calculate the times at which said vehicles will arrive at upcoming stops; (3) means communicating between the global positioning system device and the central processor means for transmitting the position of said vehicles to said central processor means; (4) means broadcasting within the area served by the transit system a system table of the calculated vehicle arrival times for the transit system; and (5) receivers selected from portable receivers, receivers at selected vehicle stops and receivers on board vehicles within the transit system, adapted for receiving the broadcast and displaying at least subsets of the transit data table associated with the selected receivers, including subsets containing predicted transit stop arrival times, advertisements and information for the operators of the vehicles.

2. The system of claim 1, further comprising means located on the vehicle for sensing the passenger load in the vehicle.

3. The system of claim 2 wherein the passenger load sensing means comprises a device for estimating the instant weight of the vehicle.

4. The system of claim 2, wherein the passenger load sensing means comprises devices for monitoring passenger ingress and egress.

5. The system of claim 2, wherein the passenger load sensing means comprises sensors for determining whether passenger seats are occupied or unoccupied.

6. A system for determining the location of vehicles operating over routes in a transit system, comprising: (1) a global positioning system device located in selected transit vehicles for monitoring the position of said vehicles; (2) means in at least said selected vehicles for sensing the passenger load of said vehicles; (3) central processor means (a) storing a transit data table containing vehicle schedules and a history of travel times for said vehicles to move from one stop to another along their routes and a history of passenger load changes as the vehicles move from one stop to another along their predetermined routes, and (b) based upon the transit data table and the position of said vehicles and the passenger load of said vehicles at a given time, calculating the predicted time at which said vehicles will arrive at upcoming stops and the passenger load of said vehicles at the upcoming stops; (4) means communicating between the vehicles, including the global positioning system devices and the passenger load sensing means, and the central processor means for transmitting the position of said vehicles and the passenger load information to said central processor means; (5) means broadcasting within the area served by the transit system a system table of said calculated predicted arrival times at upcoming stops and the associated passenger loads at the upcoming stops; and (6) means in selected locations and vehicles within the transit system, adapted for receiving the broadcast and displaying subsets of the transit data table, including subsets containing information selected from said calculated predicted transit stop arrival times and said calculated predicted passenger loads.

7. The system of claim 6, further comprising means on selected vehicles adapted for receiving the broadcast and displaying subsets of the transit data table containing operating instructions or information for the operator of the vehicle.

8. The system of claim 6, further comprising means for storing messages, including advertising and public information messages; and wherein the central processor means is adapted for selecting messages for broadcast from said stored messages, based upon the location and speed of selected vehicles as determined from information received from the global positioning system devices.

9. The system of any of claims 6 to 8, wherein the transit data table comprises a standardized format suitable for use in different transit systems and computers.

10. A system for notifying individuals of the status of one or more public transportation vehicles travelling predetermined routes, the system comprising:

a first transceiver located in selected ones of the vehicles;

global position determining device located in the vehicles, the global position determining devices in the vehicles including a computer and connected to the transceiver and communicating thereby with a plurality of global positioning system satellites for determining the location of vehicles along their routes;

a second transceiver separate from the vehicles;

at least one central processor separate from the vehicles and in communication via the second transceiver and the first transceivers in the vehicles with the global position determining devices for receiving the location of the vehicles therefrom, said central processor having access to electronically stored information concerning the routes, said information including the location of each of a plurality of stops and historical information including schedule information and transit times between stops associated with different conditions along the route, and said central processor including means for computing from the location of the vehicles and the electronically stored information a transit data table including the calculated predicted arrival time of vehicles at least at selected stops;

means broadcasting the transit data table electronically;

access means adapted for communicating with said electronic broadcasting means for receiving the transit data table and transmitting the transit data table in at least one of audio and visual formats; and further comprising means in selected vehicles for determining the number of unoccupied seats and wherein said central processor is in communication with said means for determining the number of unoccupied seats for receiving the number of unoccupied seats therefrom and wherein said central processor has the capability to determine the predicted passenger load from data stored in said processing means and add said predicted passenger load to the transit data table.

11. The system of claim 10, further comprising at least a plurality of said at least one central processor, each said central processor serving a selected group of transit vehicles, and said central processors in communication with one another for establishing a combined transit data table containing the transit data table information associated with the system.

12. The system of claim 10, further comprising means electronically broadcasting other information in addition to the transit data table; and access means adapted for communicating with said broadcasting means for receiving the transit data table and said other information and transmitting the transit data table and said other information in at least one of audio and visual formats.

13. A method of notifying persons of the status of public transportation vehicles along their routes, comprising:

operating global position determining devices located in the vehicles, the devices being in communication with a plurality of global positioning system satellites to determine the location of the vehicles along the routes;

communicating the location of the vehicles to a processing means;

in the processing means, computing from the location of the vehicles and from electronically stored information therein concerning the routes and a plurality of stops along the routes, a transit data table including the predicted arrival times of the vehicles at different stops associated with different conditions along the route;

electronically broadcasting the transit data table information;

at selected locations, accessing the broadcast information and transmitting said broadcast information in at least one of audio and visual formats; and further comprising in selected vehicles determining the passenger load and transmitting the passenger load to the processing means as a base for calculations of predicted passenger load at upcoming stops for inclusion in the transit data table information, thereby making available the predicted passenger load in the electronically broadcast transit data table information.

14. The method of claim 13, wherein the electronically broadcasting and accessing and transmitting steps include electronically broadcasting other information in addition to the transit data table information, said other information being related to at least one of the following: time of day, day of week, date, location of at least one transit vehicle, season, holiday and weather; accessing said other information and transmitting said other information in at least one of audio and visual formats; and displaying said other information in selected vehicles.

15. A system for notifying a passenger waiting for a public transportation vehicle of the arrival time of the vehicle at a public transportation stop and of the predicted passenger load on the vehicle at the stop, and of availability of seats on the vehicle, the vehicle travelling a predetermined route, the vehicle being situated at a particular location along the route and having a number of unoccupied seats, and the stop being one of a plurality of stops along the route, the system comprising:

a global position determining device located in the vehicle, said global position determining device receiving broadcasts from a plurality of global positioning system satellites for determining the location of the vehicle along the route;

passenger load determining means located in the vehicle, said passenger load determining means for determining the passenger load including the number of unoccupied seats and the availability of standing room space in the vehicle;

a central processor, said central processor in wireless communication with the global position determining device for receiving the location of the vehicle therefrom and in communication with said passenger load determining means for receiving the passenger load therefrom;

said central processor including electronically stored information concerning the route, said information including the location of each of the plurality of stops, and said processor including means for computing from the location of the vehicle and the electronically stored information the predicted arrival time of the vehicle at the stop and the predicted passenger load of the vehicle when it arrives at that stop; and access means, said access means in communication with said processor for receiving the computed arrival time and the predicted passenger load therefrom, and including means for transmitting the computed arrival time of the vehicle and the predicted passenger load in the vehicle to the waiting passenger in audio, visual or audiovisual format.

16. The system of claim 15, wherein the access means is at the stop.

17. The system of claim 15, wherein the access means is portable by the passenger.

18. The system of claim 15, wherein the access means comprises a telephone and an automated information server receiving information from the central processor.

19. The system of claim 15, wherein the access means comprises a computer.

20. A system for notifying a passenger waiting for a public transportation vehicle of the arrival time of the vehicle at a transportation stop, the vehicle travelling a predetermined route and being situated at a particular location along the route and the stop being one of a plurality of stops along the route, the system comprising:

means for determining the location of the vehicle along the route;

a first processor located on the vehicle and in communication with the position determining means for receiving the location of the vehicle therefrom, said first processor connected to first electronic storage means including information concerning the vehicle's route, said information including location of each of the plurality of stops, and said first processor including means for computing from the location of the vehicle and the electronically stored information the arrival time of the vehicle at the stop;

a second processor, said second processor located remote from the vehicle, and in wireless communication with said first processor for receiving the arrival time of the vehicle therefrom and the stop location therefrom;

display means, said display means in wireless or wireless communication or a combination thereof with said second processor for receiving the computed arrival time therefrom and for displaying the computed arrival time of the vehicle to the waiting passenger;

means located on the vehicle for determining the passenger load in the vehicle; and said second processor predicting the passenger load at upcoming stops based on the determined passenger load.

21. The system of claim 20, wherein said second processor is in wireless communication with said passenger load determining means via said first processor for receiving the passenger load therefrom.

22. The system of claim 21, wherein said display means includes means for receiving the number of unoccupied seats from said second processor and means for displaying the number of seats to the passenger.

23. A system for monitoring the location of vehicles operating over routes in a transit system, comprising: (1) means in selected vehicles for monitoring the position of said vehicles; (2) means in selected vehicles for sensing the passenger load of said vehicles; (3) system processor means (a) storing a transit data table containing vehicle schedules, transit times for said vehicles to move under different conditions from one stop to another along their routes and passenger load changes under different conditions as the vehicles move from one stop to another along their routes, and (b) based upon the transit data table and the position of said vehicles and the passenger load of said vehicles at a given time, calculating predicted times at which said vehicles will arrive at upcoming stops and the predicted passenger loads of said vehicles at the upcoming stops; (4) means communicating between the vehicles, including the monitoring means and the passenger load sensing means and the system processor means, for transmitting the position of said vehicles and the passenger load information from said vehicles to said system processor means; (5) means broadcasting within the area served by the transit system a system table of the predicted arrival times at upcoming stops and the associated predicted passenger loads at the upcoming stops; and (6) means in selected locations and vehicles within the transit system, adapted for receiving the broadcast and selectively displaying subsets of the transit data table, including subsets containing information selected from the predicted transit stop arrival times and the predicted passenger loads.

24. A method of monitoring the location of a group of vehicles operating over routes in a transit system, comprising: (1) monitoring the passenger load of the vehicles; (2) monitoring the position of the vehicles from the vehicles; (3) broadcasting the position information and the passenger load information from the vehicles; (4) at a system computer, storing a transit data table containing a compilation of vehicle schedules and transit times for the vehicles to move under different conditions from one stop to another along their routes and passenger load changes under different conditions as the vehicles move from one stop to another along their routes; (5) based upon the transit data table and the positions of the vehicles and the passenger loads of the vehicles at a given time, calculating the predicted time at which selected vehicles will arrive at upcoming stops and the passenger load of the selected vehicles at the upcoming stops; (6) broadcasting within the area served by the transit system, system data including the predicted arrival times of the selected vehicles at upcoming stops and the predicted passenger loads at the upcoming stops; and (7) at selected locations and vehicles, selectively displaying subsets of the transit data table, including subsets containing information selected from the predicted transit stop arrival times and the predicted passenger loads.

25. A system for notifying a passenger waiting for a public transportation vehicle of the arrival time of the vehicle at a transportation stop, the vehicle travelling a predetermined route and being situated at a particular location along the route and the stop being one of a plurality of stops along the route, the system comprising:

a global position determining device located in the vehicle, said global position determining device communicative with a plurality of global positioning system satellites for determining the location of the vehicle along the route;

processing means in communication with the global position determining device for receiving the location of the vehicle therefrom, said processing means having access to electronically stored information concerning the route, said information including the location of each of the plurality of stops and schedule information and a history of transit times between stops associated with different conditions along the route, and said processing means including means for computing from the location of the vehicle and the electronically stored information a transit data table including the arrival time of the vehicle at stops along the vehicle's route;

display means, said display means in wireless communication with said processing means for receiving the computed arrival time therefrom and for displaying the transit data table or a subset thereof; and further comprising means for determining the number of unoccupied seats and wherein said processing means is in communication with said means for determining the number of unoccupied seats for receiving the number of unoccupied seats therefrom and wherein said processing means has the capability to determine the predicted passenger load from data stored in said processing means and add said predicted passenger load to the transit data table.

26. The system of claim 25, wherein the display means is located at the stop.

27. The system of claim 25, wherein the display means is portable by the passenger.

28. The system of claim 25, wherein said display means includes means for receiving the predicted passenger load at a given vehicle stop and means for displaying the predicted passenger load to the passenger.

* * * * *